US008309505B2

(12) United States Patent
Fossum et al.

(10) Patent No.: US 8,309,505 B2
(45) Date of Patent: Nov. 13, 2012

(54) HAND DISH COMPOSITION IN THE FORM OF AN ARTICLE

(75) Inventors: Renae Dianna Fossum, Middletown, OH (US); Robert Wayne Glenn, Jr., Liberty Township, OH (US); Heather Anne Doria, Hamilton, OH (US); Mark Robert Sivik, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 174 days.

(21) Appl. No.: 12/847,093

(22) Filed: Jul. 30, 2010

(65) Prior Publication Data

US 2011/0028373 A1 Feb. 3, 2011

Related U.S. Application Data

(60) Provisional application No. 61/229,986, filed on Jul. 30, 2009.

(51) Int. Cl.
*C11D 17/00* (2006.01)

(52) U.S. Cl. ..... 510/235

(58) Field of Classification Search ..... 510/235
See application file for complete search history.

(56) References Cited

U.S. PATENT DOCUMENTS

| | | | | |
|---|---|---|---|---|
| 3,299,112 | A | 1/1967 | Bailey | |
| 3,594,328 | A | 7/1971 | Schibler | |
| 3,929,678 | A | 12/1975 | Laughlin et al. | |
| 4,234,627 | A | 11/1980 | Schilling | |
| 4,424,134 | A | 1/1984 | Sissin et al. | |
| 4,514,461 | A | 4/1985 | Woo | |
| 4,539,135 | A | 9/1985 | Ramachandran | |
| RE32,713 | E | 7/1988 | Woo | |
| 4,767,547 | A | 8/1988 | Straathof et al. | |
| 4,818,421 | A | 4/1989 | Boris et al. | |
| 4,882,220 | A | 11/1989 | Ono et al. | |
| 4,911,852 | A | 3/1990 | Coffindaffer et al. | |
| 4,917,920 | A | 4/1990 | Ono et al. | |
| 5,082,578 | A | 1/1992 | Langer et al. | |
| 5,264,144 | A * | 11/1993 | Moroney et al. | 510/151 |
| 5,425,892 | A * | 6/1995 | Taneri et al. | 510/146 |
| 5,457,895 | A | 10/1995 | Thompson | |
| 5,463,416 | A | 10/1995 | Paton | |
| 5,545,340 | A | 8/1996 | Wahl | |
| 5,545,350 | A | 8/1996 | Baker | |
| 5,562,849 | A | 10/1996 | Wahl | |
| 5,574,179 | A | 11/1996 | Wahl | |
| 5,635,469 | A * | 6/1997 | Fowler et al. | 510/406 |
| 5,651,976 | A | 7/1997 | Price | |
| 5,807,956 | A | 9/1998 | Czech | |
| 5,858,959 | A | 1/1999 | Surutzidis | |
| 5,981,681 | A | 11/1999 | Czech | |
| 6,048,830 | A | 4/2000 | Gallon | |
| 6,106,849 | A | 8/2000 | Malkan | |
| 6,200,949 | B1 | 3/2001 | Reijmer | |
| 6,245,732 | B1 | 6/2001 | Gallon | |
| 6,376,453 | B1 * | 4/2002 | Kubota et al. | 510/438 |
| 6,458,754 | B1 | 10/2002 | Velazquez | |
| 6,551,986 | B1 | 4/2003 | Littig | |
| 6,642,200 | B1 | 11/2003 | Zhang | |
| 6,645,479 | B1 | 11/2003 | Shefer | |
| 6,740,631 | B2 | 5/2004 | Shefer | |
| 6,787,512 | B1 | 9/2004 | Verrall | |
| 6,815,069 | B2 | 11/2004 | Hohberg | |
| 6,903,061 | B2 | 6/2005 | Masschelein | |
| 7,053,034 | B2 | 5/2006 | Shefer | |
| 7,125,835 | B2 | 10/2006 | Bennett | |
| 7,135,451 | B2 | 11/2006 | Corona, III | |
| 7,153,924 | B2 | 12/2006 | Kuepfer | |
| 7,159,834 | B1 * | 1/2007 | Abbas et al. | 249/66.1 |
| 7,196,049 | B2 | 3/2007 | Brain | |
| 7,238,655 | B2 | 7/2007 | Ness | |
| 7,256,168 | B2 * | 8/2007 | Raehse et al. | 510/446 |
| 7,273,837 | B2 | 9/2007 | Boutique | |
| 7,321,019 | B2 | 1/2008 | Ziche | |
| 7,335,630 | B2 | 2/2008 | Delplancke | |
| 7,365,043 | B2 | 4/2008 | Baker | |
| 7,381,697 | B2 | 6/2008 | Lentsch | |
| 7,427,648 | B2 | 9/2008 | Ochs | |
| 7,585,824 | B2 | 9/2009 | Popplewell | |
| 7,723,284 | B2 | 5/2010 | Mane | |
| 7,799,752 | B2 | 9/2010 | Ness | |
| 2003/0125222 | A1 | 7/2003 | Jahns | |
| 2003/0158344 | A1 | 8/2003 | Rodriques | |
| 2003/0165692 | A1 | 9/2003 | Koch | |
| 2003/0215417 | A1 | 11/2003 | Uchiyama | |
| 2003/0216488 | A1 | 11/2003 | Uchiyama | |

(Continued)

FOREIGN PATENT DOCUMENTS

| | | | |
|---|---|---|---|
| EP | 0283165 | B1 | 10/1992 |
| EP | 1141207 | | 11/1999 |
| WO | WO 00/20157 | | 4/2000 |
| WO | WO 00/56849 | | 9/2000 |
| WO | WO 03/091028 | A1 | 11/2003 |
| WO | WO 2005/002360 | | 1/2005 |
| WO | WO 2009095891 | | 8/2009 |
| WO | WO 2010043692 | A1 | 4/2010 |

OTHER PUBLICATIONS

U.S. Appl. No. 12/831,618, filed Jul. 9, 2010, Fossum, et al. U.S. Appl. No. 12/847,110, filed Jul. 30, 2010, Fossum, et al.
U.S. Appl. No. 61/024,728, filed Jan. 30, 2008, Glenn, Jr., Robert Wayne.
U.S. Appl. No. 61/045,444, filed Apr. 16, 2008, Glenn, Jr., Robert Wayne.
U.S. Appl. No. 12/361,634, filed Sep. 17, 2008, Glenn, Jr., Robert W.
U.S. Appl. No. 12/080,358, filed Oct. 2, 2008, Wahl, Errol Hoffman.
U.S. Appl. No. 61/120,637, filed Dec. 8, 2008, Glenn, Jr., Robert Wayne.
U.S. Appl. No. 61/120,643, filed Dec. 8, 2008, Glenn, Jr., Robert Wayne.

(Continued)

*Primary Examiner* — Gregory Webb
(74) *Attorney, Agent, or Firm* — Tiffany M. Zerby

(57) ABSTRACT

Hand dish compositions such as those that are typically provided to the consumer in liquid form are disclosed. The hand dish composition is in the form of a flexible, porous, dissolvable substrate. The substrate may comprise hand care compositions. The article may take any number of suitable shapes.

2 Claims, No Drawings

U.S. PATENT DOCUMENTS

| | | | | |
|---|---|---|---|---|
| 2004/0071742 | A1 | 4/2004 | Popplewell | |
| 2005/0098759 | A1 | 5/2005 | Frankenbach | |
| 2005/0170994 | A1 | 8/2005 | Casado-Dominguez | |
| 2005/0192207 | A1 | 9/2005 | Morgan, III | |
| 2006/0252668 | A1 | 11/2006 | Frankenbach | |
| 2007/0225388 | A1 | 9/2007 | Cooper | |
| 2007/0275866 | A1 | 11/2007 | Dykstra | |
| 2009/0232873 | A1* | 9/2009 | Glenn et al. | 424/443 |
| 2009/0263342 | A1* | 10/2009 | Glenn et al. | 424/70.11 |
| 2010/0167971 | A1* | 7/2010 | Glenn et al. | 510/101 |
| 2010/0173817 | A1* | 7/2010 | Glenn et al. | 510/120 |
| 2010/0279905 | A1* | 11/2010 | Glenn et al. | 510/103 |
| 2010/0286011 | A1* | 11/2010 | Glenn et al. | 510/120 |
| 2010/0291165 | A1* | 11/2010 | Glenn et al. | 424/401 |
| 2010/0298188 | A1* | 11/2010 | Glenn et al. | 510/120 |

OTHER PUBLICATIONS

U.S. Appl. No. 61/120,765, filed Dec. 8, 2008, Glenn, Jr., Robert Wayne.

U.S. Appl. No. 61/120,786, filed Dec. 8, 2008, Glenn, Jr., Robert Wayne.

U.S. Appl. No. 61/120,790, filed Dec. 8, 2008, Glenn, Jr., Robert Wayne.

U.S. Appl. No. 61/170,150, filed Apr. 17, 2009, Panandiker, Rajan Keshav.

U.S. Appl. No. 61/221,632, filed Jun. 30, 2009, Panandiker, Rajan Keshav.

U.S. Appl. No. 61/229,981, filed Jul. 30, 2009, Fossum, Renae Dianna.

U.S. Appl. No. 61/319,939, filed Apr. 1, 2010, Cox, Jeremy Wayne.

* cited by examiner

HAND DISH COMPOSITION IN THE FORM OF AN ARTICLE

CROSS-REFERENCE TO RELATED APPLICATIONS

This application claims priority under 35 U.S.C. §119(e) to U.S. Provisional Application Ser. No. 61/229,986, filed Jul. 30, 2009.

FIELD OF THE INVENTION

The present invention relates to hand dish compositions, especially those that are in the form of an article that is a porous, dissolvable solid structure and methods of making the same.

BACKGROUND OF THE INVENTION

Through the wash hand dish washing products are often sold in liquid form. Although widely used, bulk liquid product forms may have associated issues in terms of packaging, storage, transportation and/or convenience of use. For example, liquid dishwashing products are typically sold in bottles which may add significant cost to the finished product. Additionally, liquid dish washing products may comprise a substantial amount of water in the formula. The high water content increases the bulk of the product which may in turn adversely impact the associated shipping and storage costs. Additionally, liquid dish washing products can be messy. This messiness may cause inconvenience to the consumer when attempting to meter out an accurate dose as it may result in drips and residue on the outside of the bottle. With particularly compact liquids, product may remain upon dosing around the cap.

Liquid dish washing formulations often comprise relatively high levels of surfactants and polymers which may also result in physical stability challenges including, but not limited to, phase separation, gelling and creaming, any of which may lead to a shorter shelf life. Compatibility of these and other actives in a hand dishwashing formulas can be challenging due to for example: differences in the optimum pH of the actives; poor solubility of the actives leading to precipitation in the product; chemical instability of the active due to e.g., surfactant-polymer interactions which may lead to undesirable rheological aesthetics such as stringiness or gelling of the product. Further, it is desirable to be able to formulate enzymes into such product; however the presence of enzymes in liquid products often requires additional stabilizing aids to render them stable upon storage, which in turn adds to the overall cost of the formulation.

Water soluble pouches, such as those made of polyvinyl alcohol are known; however a further issue with such pouches is that they may have a tendency to burst upon storage, particularly if moisture is transferred onto the pouch, via, for example damp hands reaching into the pack of pouches. Multicompartment pouches are known, and are sometimes used to separate physically or chemically incompatible actives or additional benefit agents; however this may lead to a costly process. Tablets are also known; however an issue with such tablets is that they may have a tendency to crumble (e.g., upon transportation) owing to their brittleness.

The aforementioned issues may be addressed by providing a liquid formulation in the alternative form of a porous dissolvable solid structure containing little or no water. For example, such an article could be packaged as a single unit or in multiple units and shipped at a lower cost as compared to the traditional liquid form equivalent. Such an article could eliminate the difficulty and mess associated with handling a liquid dishwashing formulation since no metered pouring would be required. Moreover, many of the stability issues of the liquid form would be eliminated via physical separation such that actives could be combined in new ways that were heretofore impractical and/or impossible.

SUMMARY OF THE INVENTION

It is therefore an object of the present invention to provide a hand dish composition in the form of a porous, dissolvable solid structure that can be conveniently and quickly dosed and dissolved in the wash or rinse liquor. It is further desirable to provide excellent skin conditioning benefits. It is a further object of the present invention to provide such a product that can be produced in an economical manner by physical aeration followed by subsequent drying. It is an even further object of the present invention to provide such a product with desirable softness and flexibility.

DETAILED DESCRIPTION OF THE INVENTION

It has presently been found that dissolvable hand dish products can be prepared that can be conveniently and quickly dissolved in the wash liquor to provide for delivery of hand dish compositions previously provided to the consumer in liquid form. It has also been found that such products can be produced in an economical manner by physical aeration followed by subsequent drying. Additionally, it has been found that such products can now be produced with desirable softness and flexibility and in a convenient size.

Rapidly-dissolving porous solids with a predominantly open-celled structure can be produced via physical aeration followed by subsequent drying which is a more cost effective alternative to conventional freeze drying. This can be accomplished by creating a physically aerated wet foam with a controlled degree of foam instability during the drying process such that an optimum level of bubble breakage and coalescence occurs to generate a plurality of open channels. This can be accomplished without collapse of the foam plateau border three dimensional structure during the drying process thereby maintaining the physical strength and cohesiveness of the porous solid.

Instability and coalescence may be controllably manipulated such that the original closed-cell wet foam transforms within the drying process into a true open-celled porous structure wherein the plurality of open-channels extend to the solid's surfaces. Such open-celled dissolvable porous solids prepared by physical aeration followed by drying can be prepared within specific rheological and compositional ranges (% solids). Moreover, such open-celled dissolvable porous solids can be prepared with significant plasticizer levels for desirable softness and flexibility.

The flexible porous dissolvable solid structure may be referred to herein as "the article" or "the dissolvable article". All references are intended to mean the flexible porous dissolvable solid structure.

As used herein, "flexible" means that the article meets the distance to maximum force values of from about 3 mm to about 30 mm, in one embodiment from about 7 mm to about 25 mm, in another embodiment from about 8 mm to about 20 mm, and in still another embodiment from about 9 mm to about 15 mm as measured by the Distance to Maximum Force Method.

Elongation Test and Tensile-Stress Test

This test method is used to measure the elongation at break (=extensibility at break) and tensile properties of porous substrates as described herein, by applying a uniaxial strain to a sample and measuring the force that is required to elongate the sample. A preferred piece of equipment to do the tests is a tensile tester such as an MTS Synergie 100 or an MTS Alliance available from MTS Systems Corporation 14000 Technology Drive, Eden Prairie, Minn., USA, with a 25N or 50N load cell. This measures the Constant Rate of Extension in which the pulling grip moves at a uniform rate and the force measuring mechanisms moves a negligible distance (less than 0.13 mm) with increasing force. The load cell is selected such that the measured loads (e.g. force) of the tested samples will be between 10 and 90% of the capacity of the load cell.

As used herein "porous solid structure" means a solid, interconnected, polymer-containing matrix that defines a network of spaces or cells that contain the gas of the surrounding atmosphere, typically air. The interconnectivity of the structure may be described by a Star Volume, a Structure Model Index (SMI) or a Percent Open Cell Content.

The article has a Star Volume of from about 1 $mm^3$ to about 90 $mm^3$, in one embodiment from about 5 $mm^3$ to about 80 $mm^3$, in another embodiment from about 10 $mm^3$ to about 70 $mm^3$, and in still another embodiment from about 15 $mm^3$ to about 60 $mm^3$. In some embodiments, the article has a non-negative Structure Model Index of from about 0.0 to about 3.0, in one embodiment from about 0.2 to about 2.5, and in another embodiment from about 0.3 to about 2.50. In other embodiments, the article has a negative Structure Model Index of from about 0.0 to about −3.0, in one embodiment from about −0.2 to about −2.5, and in another embodiment from about −0.3 to about −1.0. The article has a Percent Open Cell Content of from about 50% to 99.9%, in one embodiment from about 60% to about 97%, and in another embodiment from about 80% to about 95%.

To measure the cell interconnectivity via the Star Volume and the Structure Model Index, samples approximately 9 mm×12 mm and 5 to 10 mm high, are scanned using a micro computed tomography system (μCT40, SN 07030700, Scanco Medical AG). Each sample is imaged while sitting flat on the bottom of a cylindrical tube. Image acquisition parameters are 35 kVp, 180 μA, 300 ms integration time, 4 averaging, and 1000 projections. The number of slices is adjusted to cover the height of the sample. The reconstructed data set consisted of a stack of images, each 2048×2048 pixels, with an isotropic resolution of 8 μm. For data analysis, a volume of interest is selected to be fully within the sample, avoiding the surface region. A typical volume of interest is 600×600×500 voxels.

Structure Model Index (SMI) is measured using Scanco Medical's Bone Trabecular Morphometry evaluation with a threshold of 35-45. With this index the structural appearance of trabecular bone is quantified (see T. Hildebrand, P. Rüegsegger. Quantification of bone microarchitecture with the structure model index. *Comp Meth Biomech Biomed Eng* 1997; 1:15-23). The triangulated surface is dilated in normal direction by an infinitesimal amount, and the new material surface (MS) and volume (MV) is calculated. By this, the derivative of the material surface (dMS/dr) can be determined. The SMI is then represented by the equation:

$$SMI=6*MV*dMS/dr*1/MaterialSurface^2$$

SMI relates to the convexity of the structure to a model type. Ideal (flat) plates have an SMI of 0 (no surface change with dilation of the plates), whereas ideal cylindrical rods have an SMI of 3 (linear increase in surface with dilation of rods). Round spheres have an SMI of 4. Concave structure gives negative dBS/dr, resulting in negative SMI values indicating that the surface is concave. Artificial boundaries at the edge of the volume of interest are not included in the calculation and thus suppressed.

In addition to the Scanco Medical Analysis, Star Volume measurements are made. Star Volume is a measure of the "openness" of the void space in a two phase structure. By choosing a random uniformly distributed set of points in the phase of interest (in this case the phase of interest is the void space or air), lines can be extended in random directions from each of these points. The lines are extended until they touch the foreground phase. The length of each of these lines is then recorded. The random points have a sampling of 10 in each direction (x/y/z) and at each point 10 random angles are chosen. If the line extends to the border of the ROI of interest that line is discarded (only accept lines that actually intersect with the foreground phase). The final equation is based upon the research entitled *Star Volume In Bone Research A Histomorphometric Analysis Of Trabecular Bone Structure Using Vertical Sections*; Vesterby, A.; Anat Rec.; 1993 February; 235(2):325-334.:

$$\text{Star Volume} = \frac{4}{3}\pi \cdot \frac{\Sigma dist^3}{N}$$

wherein "dist" is the individual distances and N is the number of lines examined.

The Percent Open Cell Content is measured via gas pycnometry. Gas pycnometry is a common analytical technique that uses a gas displacement method to measure volume accurately. Inert gases, such as helium or nitrogen, are used as the displacement medium. The sample is sealed in the instrument compartment of known volume, the appropriate inert gas is admitted, and then expanded into another precision internal volume. The pressure before and after expansion is measured and used to compute the sample volume. Dividing this volume into the sample weight gives the gas displacement density. ASTM Standard Test Method D2856 provides a procedure for determining the percentage of open cells using an older model of an air comparison pycnometer. This device is no longer manufactured. However, you can determine the percentage of open cells conveniently and with precision by performing a test which uses Micromeritics' AccuPyc Pycnometer. The ASTM procedure D2856 describes 5 methods (A, B, C, D, and E) for determining the percent of open cells of foam materials. The samples can be analyzed using an Accupyc 1340 using nitrogen gas with the ASTM foampyc software. Method C of the ASTM procedure is to be used to calculate to percent open cells. This method simply compares the geometric volume as determined using calipers and standard volume calculations to the true volume as measured by the Accupyc. It is recommended that these measurements be conducted by Micromeretics Analytical Services, Inc. (One Micromeritics Dr, Suite 200, Norcross, Ga. 30093). More information on this technique is available on the Micromeretics Analytical Services web sites (www.particletesting.com or www.micromeritics.com), or published in a book, "Analytical Methods in Fine particle Technology", by Clyde Orr and Paul Webb.

The article has a maximum Cell Wall Thickness. The article has a Cell Wall Thickness of from about from about 0.02 mm to about 0.2 mm, in one embodiment from about 0.05 mm to about 0.18 mm, in another embodiment from about 0.03 mm to about 0.14 mm, and in still another embodiment from about 0.035 mm to about 0.07 mm.

The Cell Wall Thickness is computed from the scanned images via a micro computed tomography system (μCT40, SN 07030700, Scanco Medical AG) as described herein. The Cell Wall Thickness is determined according to the method defined for the measurement of Trabecular Thickness using Scanco Medical's Bone Trabecular Morphometry evaluation. The definition of Trabecular Thickness as taken from the Scanco User's manual: Trabecular Thickness uses a Euclidean distance transformation (EDM), which calculates the Euclidean distance from any point in the foreground to the nearest background point. The Trabecular Thickness measure represents twice the centerline values associated with the local maxima of the EDM, which represents the distance to the center of the object (twice this distance will yield the thickness).

The article also has a minimum Specific Surface Area. The article has a Specific Surface Area of from about 0.03 $m^2/g$ to about 0.25 $m^2/g$, in one embodiment from about 0.035 $m^2/g$ to about 0.20 $m^2/g$, in another embodiment from about 0.04 $m^2/g$ to about 0.15 $m^2/g$, and in still another embodiment from about 0.04 $m^2/g$ to about 0.10 $m^2/g$.

The Specific Surface Area is measured via a gas adsorption technique. Surface Area is a measure of the exposed surface of a solid sample on the molecular scale. The BET (Brunauer, Emmet, and Teller) theory is the most popular model used to determine the surface area and is based upon gas adsorption isotherms. Gas Adsorption uses physical adsorption and capillary condensation to measure a gas adsorption isotherm. The technique is summarized by the following steps; a sample is placed in a sample tube and is heated under vacuum or flowing gas to remove contamination on the surface of the sample. The sample weight is obtained by subtracting the empty sample tube weight from the combined weight of the degassed sample and the sample tube. The sample tube is then placed on the analysis port and the analysis is started. The first step in the analysis process is to evacuate the sample tube, followed by a measurement of the free space volume in the sample tube using helium gas at liquid nitrogen temperatures. The sample is then evacuated a second time to remove the helium gas. The instrument then begins collecting the adsorption isotherm by dosing krypton gas at user specified intervals until the requested pressure measurements are achieved. Samples may then analyzed using an ASAP 2420 with Krypton gas adsorption.

It is recommended that the gas adsorption and pyncnometry measurements be conducted by Micromeretics Analytical Services, Inc. (One Micromeritics Dr, Suite 200, Norcross, Ga. 30093). More information on this technique is available on the Micromeretics Analytical Services web sites (www.particletesting.com or www.micromeritics.com), or published in a book, "Analytical Methods in Fine particle Technology", by Clyde Orr and Paul Webb.

In some embodiments, the article is a flat, flexible solid structure in the form of a pad, a strip or tape and having a thickness of from about 1.0 mm to about 50 mm, in one embodiment from about 2 mm to about 9 mm, in another embodiment from about 3 mm to about 8 mm, and in a further embodiment from about 4 mm to about 7 mm as measured by the below methodology. In another embodiment, the article is a three-dimensional solid structure in the form of a shape with a volume from about 0.3 $cm^3$ to about 500 $cm^3$, in another embodiment from about 1 $cm^3$ to about 300 $cm^3$, in another embodiment from about 10 $cm^3$ to about 200 $cm^3$, and in another embodiment from about 25 $cm^3$ to about 100 $cm^3$.

The thickness of the dissolvable porous solid (i.e., substrate or sample substrate) is obtained using a micrometer or thickness gage, such as the Mitutoyo Corporation Digital Disk Stand Micrometer Model Number IDS-1012E (Mitutoyo Corporation, 965 Corporate Blvd, Aurora, Ill., USA 60504). The micrometer has a 1 inch diameter platen weighing about 32 grams, which measures thickness at an application pressure of about 40.7 psi (6.32 $gm/cm^2$). In the case of cylindrical, spherical or other objects with more of a third dimension versus a pad or strip, the thickness is taken as the maximum distance of the shortest dimension, i.e., the diameter of a sphere or cylinder for instance, and the thickness ranges are the same as described above. The thickness of the dissolvable porous solid is measured by raising the platen, placing a section of the sample substrate on the stand beneath the platen, carefully lowering the platen to contact the sample substrate, releasing the platen, and measuring the thickness of the sample substrate in millimeters on the digital readout. The sample substrate should be fully extended to all edges of the platen to make sure thickness is measured at the lowest possible surface pressure, except for the case of more rigid substrates which are not flat. For more rigid substrates which are not completely flat, a flat edge of the substrate is measured using only one portion of the platen impinging on the flat portion of the substrate.

The article has a basis weight from about 800 $grams/m^2$ to about 3,500 $grams/m^2$, in another embodiment from about 900 $grams/m^2$ to about 2,500 $grams/m^2$, and in still another embodiment from about 1,500 $grams/m^2$ to about 2,000 $grams/m^2$.

The Basis Weight of the dissolvable porous solid component of the article disclosed herein is calculated as the weight of the dissolvable porous solid component per area of the selected dissolvable porous solid ($grams/m^2$). The area is calculated as the projected area onto a flat surface perpendicular to the outer edges of the porous solid. For a flat object, the area is thus computed based on the area enclosed within the outer perimeter of the sample. For a spherical object, the area is thus computed based on the average diameter as $3.14\times(\text{diameter}/2)^2$. For a cylindrical object, the area is thus computed based on the average diameter and average length as diameter×length. For an irregularly shaped three dimensional object, the area is computed based on the side with the largest outer dimensions projected onto a flat surface oriented perpendicularly to this side. This can be accomplished by carefully tracing the outer dimensions of the object onto a piece of graph paper with a pencil and then computing the area by approximate counting of the squares and multiplying by the known area of the squares or by taking a picture of the traced area (preferably shaded-in for contrast) including a scale and using image analysis techniques.

The article has a dry density of from about 0.05 $g/cm^3$ to about 0.6 $g/cm^3$, in one embodiment from about 0.15 $g/cm^3$ to about 0.40 $g/cm^3$, and in an alternate embodiment from about 0.2 $g/cm^3$ to about 0.25 $g/cm^3$.

The dry density of the dissolvable porous solid is determined by the equation:

$$\text{Calculated Dry Density}=(\text{Basis Weight of porous solid})/(\text{Porous Solid Thickness}\times 10{,}000)$$

The Basis Weight and Thickness of the dissolvable porous solid are determined in accordance with the methodologies described herein.

Rapidly dissolving porous solids with a predominantly inter-connected, open-celled structure can be produced via physical aeration followed by subsequent drying (as a more cost-effective alternative to conventional freeze drying). This can be accomplished by creating a physically aerated wet foam with a controlled degree of instability during the drying process such that an optimum level of bubble breakage and coalescence occurs to generate a plurality of open channels, and without collapse of the three dimensional foam plateau border structure during the drying process, thereby maintaining the physical strength and cohesiveness of the porous solid. This instability and coalescence can be controllably manipulated such that the original closed-cell wet foam transforms within the drying process into a true open-celled porous structure wherein the plurality of open channels extends to the solid's surface and with sufficient structural integrity.

Open-celled dissolvable porous solids prepared by physical aeration followed by drying can be achieved within a narrowly defined rheological range as defined above. Achieving the relatively low viscosity range required can be problematic due to the typically high polymeric structurant levels required for sufficient solid structure formation as well as at desired higher surfactant and % solids levels (for product compaction and sustainability). To achieve the required relatively low viscosity range of the present invention at relatively high diester quaternary ammonium compound, surfactant and polymer levels while producing integral and cohesive solid structures, several compositional strategies can be employed, either alone or in combination, including but not limited to: (i) employing water-soluble polymers within the requisite molecular weight range but with relatively low viscosity build as defined herein; (ii) deliberate dilution of the processing mixture with water in one or more steps; (iii) adding electrolyte or hydrotrope to manipulate the surfactant structure viscosity; or (iv) adding low molecular weight solvents to manipulate the viscosity. Importantly, aerating processing mixtures below the required viscosity range results in less desirable, low basis weight and non-cohesive porous solids.

It has also been found that the above described characteristics of the present invention apply toward the production of open-celled porous structures employing either semi-continuous or continuous aeration equipment from the food industry that are used in the manufacture of marshmallows.

The article may contain Remaining Water, which is defined as the amount of water in the article after drying under the specified conditions. The Remaining Water content will vary depending on the drying conditions and amount of film-forming water-soluble polymer, plasticizer and quat added to the liquid composition.

The Remaining Water in the article after drying is calculated as the difference between the theoretical water loss and the actual water loss divided by the actual mass of the article after drying. This calculation is represented by the following equation:

$$\%\ \text{Remaining Water}=[(\text{Theoretical water loss})-(\text{Actual water loss})]\div(\text{Dried Foam Mass})$$

The theoretical water loss is calculated as the wet foam mass multiplied by the percent volatile content in the liquid composition. This calculation is represented by the following equation:

$$\text{Theoretical water loss}=(\text{Wet Foam Mass})(\%\ \text{volatile content in wet composition})$$

The percent volatile content in the liquid composition is calculated as 1—the % solids of the liquid composition. This calculation is represented by the following equation:

$$\%\ \text{volatile in liquid composition}=(1-\%\ \text{solids})$$

The actual water loss is calculated gravimetrically by weighing the wet foam in the plate before drying and the plate after drying in the examples described herein.

I. Composition

The articles of the present invention may comprise: hand dish active; water-soluble polymer; surfactant; water; hydrotrope; enzyme; suds booster; divalent ion; and optional compositions including, but not limited to plasticizer. These are discussed in further detail below. Note that any actives and/or compositions disclosed herein can be used in and/or with the articles, and in particular the personal care articles, disclosed in U.S. Patent Application Ser. Nos. 61/024,728; 12/361,634; 61/120,637; 61/120,765; 61/120,790; 61/120,786; 61/120,643; 12/424,812; and 61/045,444.

Hand Dish Active

The articles of the present invention comprise one or more hand dish actives. The term "hand dish active" or "HDA" is used herein in the broadest sense to include any active that is suitable for cleaning and/or imparting other benefits to the items to be washed.

Film-Forming Water-Soluble Polymer

The article comprises at least one film-forming water-soluble polymer. As used herein, the term "film-forming water-soluble polymer" is broad enough to include both water-soluble and water-dispersible polymers, and is defined as a polymer with a solubility in water, measured at 25° C., of at least about 0.1 gram/liter (g/L). In some embodiments, the polymers have solubility in water, measured at 25° C., of from about 0.1 gram/liter (g/L) to about 500 grams/liter (g/L). (This indicates production of a macroscopically isotropic or transparent, colored or colorless solution). The polymers for making these solids may be of synthetic or natural origin and may be modified by means of chemical reactions; they may or may not be film-forming.

The one or more water-soluble polymers of the present invention are selected such that their weighted average molecular weight is from about 50,000 to about 150,000, in one embodiment from about 70,000 to about 130,000, and in yet another embodiment from about 80,000 to about 125,000. The weighted average molecular weight is computed by summing the average molecular weights of each polymer raw material multiplied by their respective relative weight percentages by weight of the total weight of polymers present within the porous solid.

The one or more film-forming water-soluble polymers may have a degree of hydrolysis by weight of the polymer ranging from about 80 to about 99%, from about 82% to about 95%, or from about 87% to about 90%.

In one embodiment, at least one of the one or more film-forming water-soluble polymers is chosen such that a 2% by weight solution of the water-soluble polymer gives a viscosity at 20° C. of from about 4 centipoise to about 80 centipoise; in an alternate embodiment from about 5 centipoise to about 70 centipoise; and in another embodiment from about 6 centipoise to about 60 centipoise.

The film-forming water-soluble polymer may be present in some embodiments of the present invention at from about 5 wt % to about 60 wt % by weight of the article of one or more water-soluble polymer, in some embodiments from about 10 wt % to about 55%, and in some embodiments from about 15% to about 45% by weight of the article of one or more water-soluble polymers.

The film-forming water-soluble polymer(s) and copolymers or derivatives thereof suitable for use as water-soluble material of the present invention can include, but are not limited to polyvinyl alcohols (PVA), modified PVAs; polyvinyl pyrrolidone; PVA copolymers such as PVA/polyvinyl pyrrolidone and PVA/polyvinyl amine; partially hydrolyzed polyvinyl acetate; polyalkylene oxides such as polyethylene oxide; polyacrylamide; polyacrylic acid; cellulose, alkyl cellulosics such as methyl cellulose, ethyl cellulose and propyl cellulose; carboxymethycelluloses; cellulose ethers; cellulose esters; cellulose amides; polyvinyl acetates; polycarboxylic acids and salts; polyaminoacids or peptides; polyamides; polyacrylamide; copolymers of maleic/acrylic acids; water soluble polyacrylates, caprolactams, polymethylmethacrylates, polymethylacrylamides, polydimethylacrylamides, polyethylene glycol monomethacrylates, polyurethanes, polyesters, polyamines, polyethyleneimines, maleic/(acrylate or methacrylate) copolymers, copolymers of methylvinyl ether and of maleic anhydride, copolymers of vinyl acetate and crotonic acid, copolymers of vinylpyrrolidone and of vinyl acetate, copolymers of vinylpyrrolidone and of caprolactam, vinyl pyrollidone/vinyl acetate copolymers, copolymers of anionic, cationic and amphoteric monomers, and combinations thereof.

The film-forming water-soluble polymer(s) which are suitable may also be selected from naturally sourced polymers including starch, modified starch; gelatin; alginates; xyloglucans, other hemicellulosic polysaccharides including xylan, glucuronoxylan, arabinoxylan, mannan, glucomannan and galactoglucomannan; and natural gums such as pectin, xanthan, and carrageenan, locus bean, arabic, tragacanth; karaya gum, tragacanth gum, gum Arabic, acemannan, konjac mannan, acacia gum, gum ghatti, whey protein isolate, and soy protein isolate; seed extracts including guar gum, locust bean gum, quince seed, and psyllium seed; seaweed extracts such as Carrageenan, alginates, and agar; fruit extracts (pectins); those of microbial origin including xanthan gum, gellan gum, pullulan, hyaluronic acid, chondroitin sulfate, and dextran; and those of animal origin including casein, gelatin, keratin, keratin hydrolysates, sulfonic keratins, albumin, collagen, glutelin, glucagons, gluten, zein, and shellac and combinations thereof.

Modified natural polymers are also useful as film-forming water-soluble polymer(s) in the present invention. Suitable modified natural polymers include, but are not limited to, cellulose derivatives such as hydroxypropylmethylcellulose, hydroxymethylcellulose, hydroxyethylcellulose, methylcellulose, hydroxypropylcellulose, ethylcellulose, carboxymethylcellulose, cellulose acetate phthalate, nitrocellulose and other cellulose ethers/esters; and guar derivatives such as hydroxypropyl guar.

Preferred film-forming water-soluble polymers of the present invention include polyvinyl alcohols, polyvinylpyrrolidones, polyalkylene oxides, starch and starch derivatives, pullulan, gelatin, hydroxypropylmethylcelluloses, methycelluloses, and carboxymethycelluloses.

More preferred film-forming water-soluble polymers of the present invention include polyvinyl alcohols, and hydroxypropylmethylcelluloses. Suitable polyvinyl alcohols include those available from Celanese Corporation (Dallas, Tex.) under the CELVOL® trade name. Suitable hydroxypropylmethylcelluloses include those available from the Dow Chemical Company (Midland, Mich.) under the METHOCEL® trade name including combinations with above mentioned hydroxypropylmethylcelluloses.

Plasticizer

The article may optionally comprise a water soluble plasticizing agent suitable for use in compositions discussed herein. Non-limiting examples of suitable plasticizing agents include polyols, copolyols, polycarboxylic acids, esters and polyesters and dimethicone copolyols.

Examples of useful polyols include, but are not limited to, glycerol, diglycerol, propylene glycol, trimethylene glycol, tetramethylene glycol, pentamethylene glycol, hexamethylene glycol, ethylene glycol, diethylene glycol, triethylene glycol, butylene glycol, pentylene glycol, cyclohexane dimethanol, dipropylene glycol n-butyl ether, 1,2 propanediol; 1,3 propanediol; 2,3-butanediol; 1,4-butanediol; 1,3-butanediol; 1,5-pentanediol; 1,6 hexanediol; dipropylene glycol; 1,2,3-propanetriol; 2-methyl 1,3-propanediol; hexylene glycol; 1,2-hexanediol; 1,2-pentanediol; 1,2-butanediol; 1,4-cyclohexanedimethanol; pinacol; 2,4-dimethyl-2,4-pentanediol; 2,2,4-trimethyl-1,3-pentanediol; ethoxylates of 2,2,4-trimethyl-1,3-pentanediol; 2-ethyl-1,3-hexanediol; phenoxyethanol; butyl carbitol; triethanolamine; 1,4-cyclohexanedimethanol; pinacol; 2,4-dimethyl-2,4-pentanediol; 2,2,4-trimethyl-1,3-pentanediol; ethoxylates of 2,2,4-trimethyl-1,3-pentanediol; polyethylene glycols (200-600), alcohols such as ethanol; propanol; isopropanol; n-propanol; n-butanol; t-butanol; phenylethyl alcohol; sugar alcohols such as sorbitol, manitol, lactitol and other mono- and polyhydric low molecular weight alcohols (e.g., $C_2$-$C_8$ alcohols); mono di- and oligo-saccharides such as fructose, glucose, sucrose, maltose, lactose, and high fructose corn syrup solids and ascorbic acid.

Examples of polycarboxylic acids include, but are not limited to citric acid, maleic acid, succinic acid, polyacrylic acid, and polymaleic acid.

Examples of suitable esters include, but are not limited to, glycerol triacetate, acetylated-monoglyceride, diethyl phthalate, triethyl citrate, tributyl citrate, acetyl triethyl citrate, acetyl tributyl citrate triethanolamine acetate; ethanol acetamide; sodium citrate; trioctyl citrate.

Examples of suitable dimethicone copolyols include, but are not limited to, PEG-12 dimethicone, PEG/PPG-18/18 dimethicone, and PPG-12 dimethicone.

Other suitable plasticizers include, but are not limited to, ethanol acetamide; propylene carbonate; glycerin carbonate; ethylene carbonate; alkyl and allyl phthalates; napthalates; lactates (e.g., sodium, ammonium and potassium salts); sorbeth-30; urea; lactic acid; sodium pyrrolidone carboxylic acid (PCA); sodium hyraluronate or hyaluronic acid; soluble collagen; modified protein; monosodium L-glutamate; alpha & beta hydroxyl acids such as glycolic acid, lactic acid, citric acid, maleic acid and salicylic acid; glyceryl polymethacrylate; polymeric plasticizers such as polyquaterniums; proteins and amino acids such as glutamic acid, aspartic acid, and lysine; hydrogen starch hydrolysates; other low molecular weight esters (e.g., esters of $C_2$-$C_{10}$ alcohols and acids); and any other water soluble plasticizer known to one skilled in the art of the foods and plastics industries; and mixtures thereof.

Preferred plasticizers include glycerin and propylene glycol. EP 0283165 B1 discloses other suitable plasticizers, including glycerol derivatives such as propoxylated glycerol.

The plasticizer, may be present from 0 wt % to about 20 wt %, by weight of the article of a plasticizer, alternatively from about 1 wt % to about 15 wt % and in one embodiment from about 2 wt % to about 10 wt %, by weight of the article of a plasticizer.

Surfactant

The article comprises one or more surfactants suitable for use in hand dish compositions. Surfactants suitable for use in the article include nonionic surfactants anionic surfactants, cationic surfactants, zwitterionic surfactants, amphoteric surfactants, or combinations thereof.

The one or more surfactants may be present from about 5 wt % to about 70 wt % by weight of the article of surfactant, in one embodiment from about 10 wt % to about 60 wt %, and in another embodiment from about 15 wt % to about 55 wt % by weight of the article of surfactant.

The surfactant component may also include surfactant that is intended primarily as a process aid in making a stable foam structure. Examples of emulsifiers for use as a surfactant component herein include mono- and di-glycerides, fatty alcohols, polyglycerol esters, propylene glycol esters, sorbitan esters and other emulsifiers known or otherwise commonly used to stabilized air interfaces.

Anionic Surfactants—The anionic surfactants useful in the present invention are preferably selected from the group consisting of, linear alkylbenzene sulfonate, alpha olefin sulfonate, paraffin sulfonates, alkyl ester sulfonates, alkyl sulfates, alkyl alkoxy sulfate, alkyl sulfonates, alkyl alkoxy carboxylate, alkyl alkoxylated sulfates, sarcosinates, taurinates, and mixtures thereof. An effective amount, typically from about 0.5% to about 90%, preferably about 5% to about 60%, more preferably from about 10 to about 30%, by weight of anionic detersive surfactant can be used in the present invention.

Alkyl sulfate surfactants are another type of anionic surfactant of importance for use herein. In addition to providing excellent overall cleaning ability when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula $ROSO_3M$ wherein R preferably is a $C_{10}$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperidinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., above about 50° C.). Alkyl alkoxylated sulfate surfactants are another category of useful anionic surfactant. These surfactants are water soluble salts or acids typically of the formula $RO(A)_mSO_3M$ wherein R is an unsubstituted $C_{10}$-$C_{24}$ alkyl or hydroxyalkyl group having a $C_{10}$-$C_{24}$ alkyl component, preferably a $C_{12}$-$C_{20}$ alkyl or hydroxyalkyl, more preferably $C_{12}$-$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are $C_{12}$-$C_{18}$ alkyl polyethoxylate (1.0) sulfate, $C_{12}$-$C_{18}$ alkyl polyethoxylate (2.25) sulfate, $C_{12}$-$C_{18}$ alkyl polyethoxylate (3.0) sulfate, and $C_{12}$-$C_{18}$ alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Secondary Surfactants—Secondary detersive surfactant can be selected from the group consisting of nonionics, cationics, ampholytics, zwitterionics, and mixtures thereof. By selecting the type and amount of detersive surfactant, along with other adjunct ingredients disclosed herein, the present detergent compositions can be formulated to be used in the context of laundry cleaning or in other different cleaning applications, particularly including dishwashing. The particular surfactants used can therefore vary widely depending upon the particular end-use envisioned. Suitable secondary surfactants are described below. Examples of suitable nonionic, cationic amphoteric and zwitterionic surfactants are given in "Surface Active Agents and Detergents" (Vol. I and II by Schwartz, Perry and Berch) Nonionic Detergent Surfactants—Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants include: amine oxides, alkyl ethoxylate, alkanoyl glucose amide, alkyl betaines, sulfobetaine and mixtures thereof.

Amine oxides are semi-polar nonionic surfactants and include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure. These amine oxide surfactants in particular include $C_{10}$-$C_{18}$ alkyl dimethyl amine oxides and $C_8$-$C_{12}$ alkoxy ethyl dihydroxy ethyl amine oxides. Preferably the amine oxide is present in the composition in an effective amount, more preferably from about 0.1% to about 20%, even more preferably about 0.1% to about 15%, even more preferably still from about 0.5% to about 10%, by weight.

The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal® CO-630, marketed by the GAF Corporation; and Triton®X-45, X-114, X-100, and X-102, all marketed by the Rohm & Haas Company. These compounds are commonly referred to as alkyl phenol alkoxylates, (e.g., alkyl phenol ethoxylates).

The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol. Examples of commercially available nonionic surfactants of this type include Tergitol® 15-S-9 (the condensation product of $C_{11}$-$C_{15}$ linear secondary alcohol with 9 moles ethylene oxide), Tergitol® 24-L-6 NMW (the condensation product of $C_{12}$-$C_{14}$ primary alcohol with 6 moles ethylene oxide with a narrow molecular weight distribution), both marketed by Union Carbide Corporation; Neodol® 45-9 (the condensation product of $C_{14}$-$C_{15}$ linear alcohol with 9 moles of ethylene oxide), Neodol® 23-6.5 (the condensation product of $C_{12}$-$C_{13}$ linear alcohol with 6.5 moles of ethylene oxide), Neodol® 45-7 (the condensation product of $C_{14}$-$C_{15}$ linear alcohol with 7 moles of ethylene oxide), Neodol® 454 (the condensation product of $C_{14}$-$C_{15}$ linear alcohol with 4 moles of ethylene oxide), marketed by Shell Chemical Company, and Kyro® EOB (the condensation product of $C_{13}$-$C_{15}$ alcohol with 9 moles ethylene oxide), marketed by The Procter & Gamble Company. Other commercially available nonionic surfactants include Dobanol 91-8® marketed by Shell Chemical Co. and Genapol UD-080® marketed by Hoechst. This category of nonionic surfactant is referred to generally as "alkyl ethoxylates."

The preferred alkylpolyglycosides have the formula $$R^{20}(C_nH_{2n}O)_t(\text{glycoxyl})_x$$

wherein $R^2$ is selected from the group consisting of alkyl, alkyl-phenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their I-position and the preceding glycosyl units 2-, 3-, 4- and/or 6-position, preferably predominantly the 2-position.

Fatty acid amide surfactants may be of use. Preferred amides are $C_8$-$C_{20}$ ammonia amides, monoethanolamides, diethanolamides, and isopropanolamides.

Preferably the nonionic surfactant, when present in the composition, is present in an effective amount, more preferably from about 0.1% to about 20%, even more preferably about 0.1% to about 15%, even more preferably still from about 0.5% to about 10%, by weight.

Polyhydroxy Fatty Acid Amide Surfactant—The detergent compositions hereof may also contain an effective amount of polyhydroxy fatty acid amide surfactant. By "effective amount" is meant that the formulator of the composition can select an amount of polyhydroxy fatty acid amide to be incorporated into the compositions that will improve the cleaning performance of the detergent composition. In general, for conventional levels, the incorporation of about 1%, by weight, polyhydroxy fatty acid amide will enhance cleaning performance.

The detergent compositions herein will typically comprise about 1% weight basis, polyhydroxy fatty acid amide surfactant, preferably from about 3% to about 30%, of the polyhydroxy fatty acid amide.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G. B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

Water

Raw materials used to prepare the porous dissolvable solid structure may contain water as received from the supplier. The film-forming water soluble polymer and plasticizer are hygroscopic and care must be taken to protect these materials from absorbing water in the presence of humid air. Calculations for solids content and activity are performed using the information that is provided on the certificates of analyses provided by the supplier. Water may be added to the composition as a viscosity modifier during the making of the dissolvable porous substrates either before, or during the aeration step.

Hydrotrope

The article comprises one or more hydrotropes suitable for use in hand dish compositions. The one or more hydrotropes may be present from about 0.05 wt % to about 10 wt % by weight of the article of hydrotrope, in one embodiment from about 0.1 wt % to about 8 wt %, and in another embodiment from about 0.5 wt % to about 6 wt % by weight of the article of hydrotrope.

Suitable hydrotropes include, but are not limited to, those selected from the group of: sodium, potassium, ammonium or water-soluble substituted ammonium salts of toluene sulfonic acid, naphthalene sulfonic acid, cumene sulfonic acid, xylene sulfonic acid and mixtures thereof.

Enzyme

The article may optionally comprise one or more enzymes suitable for use in hand dish compositions. The one or more enxymes may be present from 0 wt % to about 0.5 wt % by weight of the article of enzyme, in one embodiment from about 0.1 wt % to about 0.4 wt %, and in another embodiment from about 0.15 wt % to about 0.35 wt % by weight of the article of enzyme.

Enzymes—Detergent compositions of the present invention may further comprise one or more enzymes which provide cleaning performance benefits. Said enzymes include enzymes selected from cellulases, hemicellulases, peroxidases, proteases, glucoamylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from about 0.0001% to about 5% of active enzyme by weight of the detergent composition.

Proteolytic Enzyme—The proteolytic enzyme can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase®D (Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251, 446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN'). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN', Protease A and Protease B (Genencor), and mixtures thereof. Protease B is most preferred.

Of particular interest for use herein are the proteases described in U.S. Pat. No. 5,470,733.

Other Ingredients—The detergent compositions will further preferably comprise one or more detersive adjuncts selected from the following: soil release polymers, polymeric dispersants, polysaccharides, abrasives, bactericides, tarnish inhibitors, builders, enzymes, dyes, buffers, antifungal or mildew control agents, insect repellents, perfumes, opacifiers, hydrotropes, thickeners, processing aids, suds boosters, brighteners, anti-corrosive aids, stabilizers antioxidants and chelants. A wide variety of other ingredients useful in detergent compositions can be included in the compositions herein, including other active ingredients, carriers, hydrotropes, antioxidants, processing aids, dyes or pigments, solvents for liquid formulations, solid fillers for bar compositions, etc. If high sudsing is desired, suds boosters such as the $C_{10}$-$C_{16}$ alkanolamides can be incorporated into the compositions, typically at 1%-10% levels. The $C_{10}$-$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the detergent compositions of the present invention. They can be any conventional antioxidant used in detergent compositions, such as 2,6-di-tert-butyl4-methylphenol (BE), carbamate, ascorbate, thiosulfate, monoetbanolamine(MA), diethanolamine, triethanolamine, etc. It is preferred that the antioxidant, when present, be present in the composition from about 0.001% to about 5% by weight.

Suds Booster

The article comprises one or more suds boosters suitable for use in hand dish compositions. The one or more suds boosters may be present from about 1 wt % to about 10 wt % by weight of the article of suds booster, in one embodiment from about 2 wt % to about 9 wt %, and in another embodiment from about 3 wt % to about 8 wt % by weight of the article of suds booster.

Non-limiting examples of suitable polymeric suds boosters include materials based on homopolymer of 2-dimethylaminoethyl methacrylate (DMAM) and protenacious suds stabilizers, as disclosed in U.S. Pat. Nos. 6,207,631 B1, 6,372,708; alkoxylated polyethylene imines such as those disclosed in US, 2006/0234895A1, U.S. Pat. Nos. 4,597,898, 6,004,922

Preferred polymeric suds stabilizers are polymers containing any at least one monomeric unit of the formula:

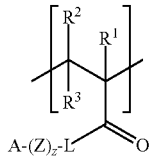

While, it is preferred that the polymeric suds stabilizers be selected from homopolymer, copolymers and terpolymers, other polymers (or multimers) of the at least one monomeric unit, the polymeric suds stabilizers can also be envisioned via polymerization of the at least one monomeric unit with a wider selection of monomers. That is, all the polymeric suds stabilizers can be a homopolymers, copolymers, terpolymers, etc. of the at least one monomeric unit, or the polymeric suds stabilizer can be copolymers, terpolymers, etc. containing one, two or more of the at least one monomeric unit and one, two or more monomeric units other than the at least one monomeric unit. For example a suitable homopolymer is:

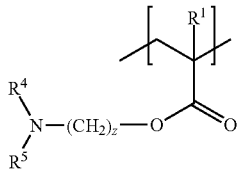

wherein $R^1$, $R^4$, $R^5$ and z are as hereinbefore defined. For example a suitable copolymer is:

(i)

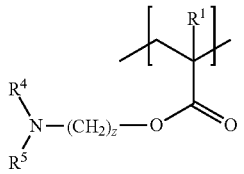

wherein $R^1$, $R^4$, $R^5$ and z are as hereinbefore defined; and (ii)

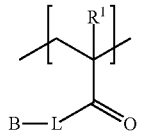

wherein $R^1$ and L are as hereinbefore defined, and B is selected from the group consisting of hydrogen, $C_1$ to $C_8$ hydrocarbyl, $NR^4R^5$, and mixtures thereof; wherein each of $R^4$ and $R^5$ are independently selected from the group consisting of hydrogen, $C_1$ to $C_8$ alkyl, and mixtures thereof, or $NR^4R^5$ form a heterocyclic ring containing from 4 to 7 carbon atoms, optionally containing additional hetero atoms, optionally fused to a benzene ring, and optionally substituted by $C_1$ to $C_8$ hydrocarbyl;

wherein ratio of (i) to (ii) is from about 99:1 to about 1:10.

Some preferred examples of

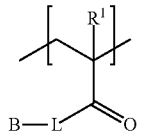

are:

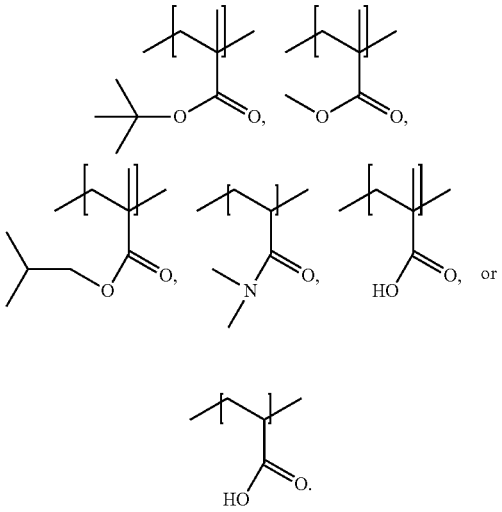

For example a copolymer can be made from two monomers, G and H, such that G and H are randomly distributed in the copolymer, such as GHGGHGGGGGHHG . . . etc.

or G and H can be in repeating distributions in the copolymer, for example

GHGHGHGHGHGHGH . . . etc., or

GGGGGHHGGGGGHH . . . etc.,

The same is true of the terpolymer, the distribution of the three monomers can be either random or repeating.

For example a suitable polymeric suds stabilizer, which is a copolymer is:

i)

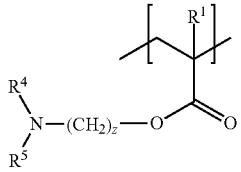

wherein $R^1$, $R^4$, $R^5$ and z are as hereinbefore defined; and ii)

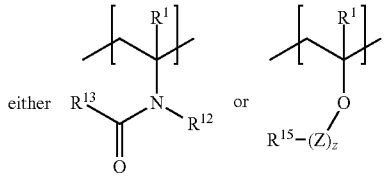

wherein $R^1Z$ and z are as hereinbefore defined, each of $R^{12}$ and $R^{13}$ are independently selected from the group consisting of hydrogen, $C_1$ to $C_8$ alkyl and mixtures thereof, preferably, hydrogen, $C_1$ to $C_3$, and mixtures thereof, more preferably hydrogen, methyl, or $R^{12}$ and $R^{13}$ form a heterocyclic ring containing from 4 to 7 carbon atoms; and $R^{15}$ is selected from the group consisting of hydrogen, $C_1$ to $C_8$ alkyl and mixtures thereof, preferably, hydrogen, $C_1$ to $C_3$, and mixtures thereof, more preferably hydrogen, methyl, wherein ratio of (i) to (ii) is from about 99:1 to about 1:10.

Some preferred at least one monomeric units, which can be additionally combined together to from copolymers and terpolymers include:

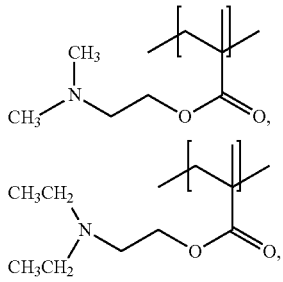

-continued

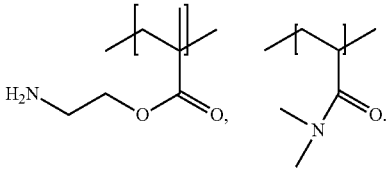

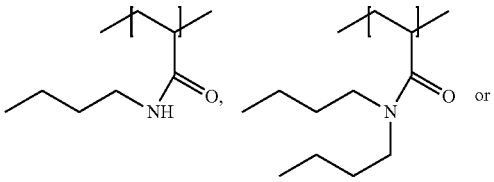

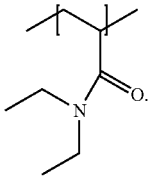

An example of a preferred homopolymer is 2-dimethylaminoethyl methacrylate (DMAM) having the formula:

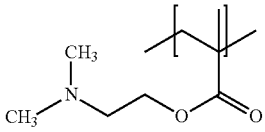

Some preferred copolymers include:
copolymers of

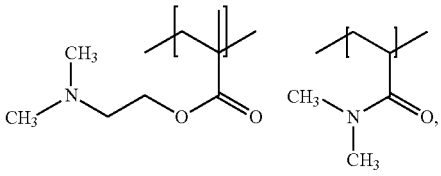

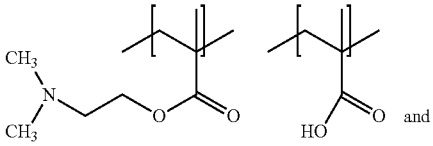

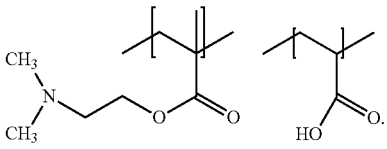

An example of a preferred copolymer is the (DMA)/(DMAM) copolymer having the general formula:

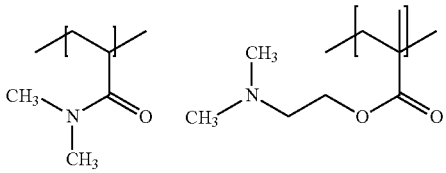

wherein the ratio of (DMA) to (DMAM) is about 1 to about 10, preferably about 1 to about 5, more preferably about 1 to about 3.

An example of a preferred copolymer is the (DMAM)/(DMA) copolymer having the general formula:

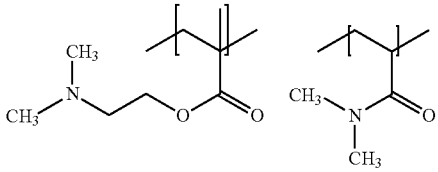

wherein the ratio of (DMAM) to (DMA) is about 1 to about 5, preferably about 1 to about 3.

The liquid detergent compositions according to the present invention comprise at least an effective amount of the polymeric suds stabilizers described herein, preferably from about 0.01% to about 10%, more preferably from about 0.05% to about 5%, most preferably from about 0.1% to about 2% by weight, of said composition. What is meant herein by "an effective amount polymeric suds stabilizers" is that the suds volume and suds duration produced by the presently described compositions are sustained for an increased amount of time relative to a composition which does not comprise one or more of the polymeric suds stabilizer described herein. Additionally, the polymeric suds stabilizer can be present as the free base or as a salt. Typical counter ions include, citrate, maleate, sulfate, chloride, etc.

The liquid detergent compositions according to the present invention comprise at least an effective amount of the polymeric suds stabilizers described herein, preferably from about 0.01% to about 10%, more preferably from about 0.05% to about 5%, most preferably from about 0.1% to about 2% by weight, of said composition. What is meant herein by "an effective amount polymeric suds stabilizers" is that the suds volume and suds duration produced by the presently described compositions are sustained for an increased amount of time relative to a composition which does not comprise one or more of the polymeric suds stabilizer described herein. Additionally, the polymeric suds stabilizer can be present as the free base or as a salt. Typical counter ions include, citrate, maleate, sulfate, chloride, etc.

Divalent Ion

The article comprises one or more divalent ions suitable for use in hand dish compositions. The one or more divalent ions may be selected from the group of organic counter ions; hardness ions; and mixtures thereof. The divalent ions may be present in the articles from about 1 wt % to about 10 wt % by weight of the article of divalent ions, in one embodiment from about 2 wt % to about 9 wt %, and in another embodiment from about 3 wt % to about 8 wt % by weight of the article of divalent ions.

Optional Components

The article may further comprise optional components that are known for use or otherwise useful in hand dish compositions, provided that such optional materials are compatible with the selected essential materials described herein, or do not otherwise unduly impair product performance.

Organic Diamine

The preferred liquid detergent compositions of the present invention further comprise one or more diamines, preferably an amount of diamine such that the ratio of anionic surfactant present to the diamine is from about 40:1 to about 2:1. Said diamines provide for increased removal of grease and greasy food material while maintaining suitable levels of suds.

It is preferred to include from about 0.1% to about 15%, preferably from about 0.5% to about 10%, more preferably from about 0.5% to about 6% even more preferably still from about 0.5% to about 1.5%, by weight, of a diamines in the preferred liquid detergent compositions.

The diamines suitable for use in the compositions of the present invention have the formula:

wherein each $R^9$ is independently selected from the group consisting of hydrogen, $C_1$-$C_4$ linear or branched alkyl alkyleneoxy having the formula:

$$—(R^{10}O)_6R^{11}$$

wherein $R^{10}$ is $C_2$-$C_4$ linear or branched alkylene, and mixtures thereof; $R^{11}$ is hydrogen, $C_1$-$C_4$ alkyl, and mixtures thereof; y is from 1 to about 10; X is a unit selected from:

i) $C_3$-$C_{10}$ linear alkylene, $C_3$-$C_{10}$ branched alkylene, $C_3$-$C_{10}$ cyclic alkylene, $C_3$-$C_{10}$ branched cyclic alkylene, an alkyleneoxyalkylene having the formula:

$$—(R^{10}O)_yR^{10}—$$

wherein $R^{10}$ and y are the same as defined herein above;

ii) $C_3$-$C_{10}$ linear, $C_3$-$C_{10}$ branched linear, $C_3$-$C_{10}$ cyclic, $C_3$-$C_{10}$ branched cyclic alkylene, $C_6$-$C_{10}$ arylene, wherein said unit comprises one or more electron donating or electron withdrawing moieties which provide said diamine with a $pK_a$ greater than about 8; and iii) mixtures of (i) and (ii)

The preferred diamines of the present invention have a $pK_1$ and $pK_2$ which are each in the range of from about 8 to about 11.5, preferably in the range of from about 8.4 to about 11, more preferably from about 8.6 to about 10.75. For the purposes of the present invention the term "$pK_a$" stands equally well for the terms "$pK_1$" and "$pK_2$" either separately or collectively. The term $pK_a$ as used herein throughout the present specification in the same manner as used by those of ordinary skill in the art. $pK_a$ values are readily obtained from standard literature sources, for example, "Critical Stability Constants: Volume 2, Amines" by Smith and Martel, Plenum Press, N.Y. and London, (1975).

As an applied definition herein, the $pK_a$ values of the diamines are specified as being measured in an aqueous solution at 25° C. having an ionic strength of from about 0.1 to about 0.5 M. As used herein, the $pK_a$ is an equilibrium constant dependent upon temperature and ionic strength, therefore, value reported by literature references, not measured in the above described manner, may not be within full agreement with the values and ranges which comprise the present invention. To eliminate ambiguity, the relevant conditions and/or references used for $pK_a$'s of this invention are as defined herein or in "Critical Stability Constants: Volume 2, Amines". One typical method of measurement is the potentiometric titration of the acid with sodium hydroxide and determination of the $pK_a$ by suitable methods as described and referenced in "The Chemist's Ready Reference Handbook" by Shugar and Dean, McGraw Hill, N.Y., 1990.

Preferred diamines for performance and supply considerations are 1,3-bis(methylamino)cyclohexane, 1,3-diaminopropane ($pK_1$=10.5; $pK_2$=8.8), 1,6-diaminohexane ($pK_1$=11; $pK_2$=10), 1,3-diaminopentane (Dytek EP) ($pK_1$=10.5; $pK_2$=8.9), 2-methyl 1,5-diaminopentane (Dytek A) ($pK_1$=11.2; $pK_2$=10.0). Other preferred materials are the primary/primary diamines having alkylene spacers ranging from $C_4$-$C_8$. In general, primary diamines are preferred over secondary and tertiary diamines.

The following are non-limiting examples of diamines suitable for use in the present invention.

1-N,N-dimethylamino-3-aminopropane having the formula:

1,6-diaminohexane having the formula:

1,3-diaminopropane having the formula:

2-methyl-1,5-diaminopentane having the formula:

1,3-diaminopentane, available under the tradename Dytek EP, having the formula:

1,3-diaminobutane having the formula:

Jeffamine EDR 148, a diamine having an alkyleneoxy backbone, having the formula:

3-methyl-3-aminoethyl-5-dimethyl-1-aminocyclohexane (isophorone diamine) having the formula:

1,3-bis(methylamino)cyclohexane having the formula:

Hand Care Agents

Skin care agents may also be included to impart a mildness feel to the hands. These may include oils and emollients, softening agents such as fatty acid esters, sugar esters, antibacterial agents, probiotic agents.

Deposition Aid

In one aspect, the dissolvable dissolvable porous substrate may comprise from about 0.01% to about 20%, from about 0.1 to about 15%, or from about 0.2 to about 10% of a deposition aid. Suitable deposition aids are disclosed in, for example, USPA Ser. No. 12/080,358.

In one aspect, the deposition aid may be a cationic or amphoteric polymer. In one aspect, the deposition aid may be a cationic polymer. Cationic polymers in general and their method of manufacture are known in the literature. In one aspect, the cationic polymer may have a cationic charge density of from about 0.005 to about 23, from about 0.01 to about 12, or from about 0.1 to about 7 milliequivalents/g, at the pH of intended use of the composition. For amine-containing polymers, wherein the charge density depends on the pH of the composition, charge density is measured at the intended use pH of the product. Such pH will generally range from about 2 to about 11, more generally from about 2.5 to about 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in WO 00/56849 and U.S. Pat. No. 6,642,200.

Suitable polymers may be selected from the group consisting of cationic or amphoteric polysaccharide, polyethyleneimine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N-dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropylpentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkyleneglyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneimine useful herein is that sold under the tradename Lupasol® by BASF, AG, Lugwigschaefen, Germany In another aspect, the treatment composition may comprise an amphoteric deposition aid polymer so long as the polymer possesses a net positive charge. Said polymer may have a cationic charge density of about 0.05 to about 18 milliequivalents/g.

In another aspect, the deposition aid may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-prop ylene-2-ol-ammonium dichloride), Suitable deposition aids include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

In one aspect, the deposition aid may comprise polyethyleneimine or a polyethyleneimine derivative. In another aspect, the deposition aid may comprise a cationic acrylic based polymer. In a further aspect, the deposition aid may comprise a cationic polyacrylamide. In another aspect, the deposition aid may comprise a polymer comprising polyacrylamide and polymethacrylamidopropyl trimethylammonium cation. In another aspect, the deposition aid may comprise poly(acrylamide-N-dimethyl aminoethyl acrylate) and its quaternized derivatives. In this aspect, the deposition aid may be that sold under the tradename Sedipur®, available from BTC Specialty Chemicals, a BASF Group, Florham Park, N.J. In a yet further aspect, the deposition aid may comprise poly(acrylamide-co-methacrylamidopropyltrimethyl ammonium chloride). In another aspect, the deposition aid may comprise a non-acrylamide based polymer, such as that sold under the tradename Rheovis® CDE, available from Ciba Specialty Chemicals, a BASF group, Florham Park, N.J., or as disclosed in USPA 2006/0252668. In another aspect the deposition aid may comprise copolymer of poly(vinyl alcohol) and poly(vinyl amine) such as that sold under the tradenames of Celvol SP L12, Celvol SP L6, Celvol SP M12, Celvol SP M6, from Celanese in Dallas, Tex.

In another aspect, the deposition aid may be selected from the group consisting of cationic or amphoteric polysaccharides. In one aspect, the deposition aid may be selected from the group consisting of cationic and amphoteric cellulose ethers, cationic or amphoteric galactomanan, cationic guar gum, cationic or amphoteric starch, and combinations thereof.

Another group of suitable cationic polymers may include alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

Another group of suitable synthetic cationic polymers may include polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™. These polymers are described in Wet Strength resins and their applications edited by L. L. Chan, TAPPI Press (1994).

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The weight-average molecular weight of the polymer may be from about 500 to about 5,000,000, or from about 1,000 to about 2,000,000, or from about 2,500 to about 1,500,000 Daltons, as determined by size exclusion chromatography relative to polyethyleneoxide standards with RI detection. In one aspect, the MW of the cationic polymer may be from about 500 to about 150,000 Daltons.

Builder

The compositions according to the present invention may further comprise a builder system. Any conventional builder system is suitable for use herein including aluminosilicate materials, silicates, polycarboxylates and fatty acids, materials such as ethylene-diamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula R—CH(COOH) $CH_2$(COOH) wherein R is C10-20 alkyl or alkenyl, preferably $C_{12-16}$, or wherein R can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid execution herein, suitable fatty acid builders for use herein are saturated or unsaturated C10-18 fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

Detergency builder salts are normally included in amounts of from 3% to 50% by weight of the composition preferably from 5% to 30% and most usually from 5% to 25% by weight.

Neat Perfumes and Perfume Delivery Systems

In some embodiments, the article comprises neat perfume and/or perfume delivery systems, each of which is discussed in further detail below. The neat perfume and/or perfume delivery system may be incorporated into the composition that is manipulated to form the porous, dissolvable solid structure. In addition or in the alternative, the neat perfume and/or perfume delivery system may be applied to the porous, dissolvable solid structure after it is formed. This step is discussed in the "Method of Manufacturing" section below.

Any suitable neat perfume may be of use in the article. Non-limiting examples of neat perfumes of use are described in U.S. Patent Publication No. 2005/0192207A1.

Any suitable perfume delivery system may be of use in the article. Non-limiting examples of such systems are described in U.S. Patent Publication No. 2007/0275866A1 and include the following: starch encapsulated accord; perfume microcapsule; and perfume loaded zeolite.

Starch Encapsulated Accord

The use of starch encapsulated accord or "SEA", technology allows one to modify the properties of a perfume, for example, by converting a liquid perfume into a solid by adding components such as starch. The benefit includes increased perfume retention during product storage, especially under non-aqueous conditions. Upon exposure to moisture, a perfume bloom may be triggered. Benefits at other times may also be achieved because the starch allows the product formulator to select perfume raw material(s) concentrations that normally cannot be used without the presence of SEA. Another technology example includes the use of other organic and inorganic materials, such as silica to convert perfume from liquid to solid. Suitable SEAs as well as methods of making same may be found in U.S. Patent Publication No. 2005/0003980 A1 and U.S. Pat. No. 6,458,754 B1.

Perfume Microcapsule

For purposes of the present invention and unless indicated otherwise, the terms "perfume nanocapsule" and "microcapsule" are within the scope of the term "perfume microcapsule."Microcapsules of the current invention are formed by a variety of procedures that include, but are not limited to, coating, extrusion, spray-drying, interfacial, in-situ and matrix polymerization. The possible shell materials vary widely in their stability toward water. Among the most stable are polyoxymethyleneurea (PMU)-based materials, which may hold certain PRMs for even long periods of time in aqueous solution (or product). Such systems include but are not limited to urea-formaldehyde and/or melamine-formaldehyde. Gelatin-based microcapsules may be prepared so that they dissolve quickly or slowly in water, depending for example on the degree of cross-linking. Many other capsule wall materials are available and vary in the degree of perfume diffusion stability observed. Without wishing to be bound by theory, the rate of release of perfume from a capsule, for example, once deposited on a surface is typically in reverse order of in-product perfume diffusion stability. As such, urea-formaldehyde and melamine-formaldehyde microcapsules for example, typically require a release mechanism other than, or in addition to, diffusion for release, such as mechanical force (e.g., friction, pressure, shear stress) that serves to break the capsule and increase the rate of perfume (fragrance) release. Other triggers include melting, dissolution, hydrolysis or other chemical reaction, electromagnetic radiation, and the like. The use of pre-loaded microcapsules requires the proper ratio of in-product stability and in-use and/or on-surface (on-situs) release, as well as proper selection of PRMs. Microcapsules that are based on urea-formaldehyde and/or melamine-formaldehyde are relatively stable, especially in near neutral aqueous-based solutions. These materials may require a friction trigger which may not be applicable to all product applications. Other microcapsule materials (e.g., gelatin) may be unstable in aqueous-based products and may even provide reduced benefit (versus free perfume control) when in-product aged. Scratch and sniff technologies are yet another example of PAD. Perfume microcapsules (PMC) may include those described in the following references: U.S. Patent Application Nos.: 2003/0125222 A1; 2003/215417 A1; 2003/216488 A1; 2003/158344 A1; 2003/165692 A1; 2004/071742 A1; 2004/071746 A1; 2004/072719 A1; 2004/072720 A1; 2006/0039934 A1; 2003/203829 A1; 2003/195133 A1; 2004/087477 A1; 2004/0106536 A1; and U.S. Pat. Nos. 6,645,479 B1; 6,200,949 B1; 4,882,220; 4,917,920; 4,514,461; 6,106,875 and 4,234,627, 3,594,328 and U.S. RE 32713.

Perfume Loaded Zeolite

This technology relates to the use of porous zeolites or other inorganic materials to deliver perfumes. Perfume-loaded zeolite may be used with or without adjunct components used for example to coat the perfume-loaded zeolite (PLZ) to change its perfume release properties during product storage or during use or from the dry situs. Suitable zeolite and inorganic carriers as well as methods of making same may be found in U.S. Patent Application No. 2005/0003980 A1 and U.S. Pat. Nos. 5,858,959; 6,245,732 B1; 6,048,830 and 4,539,135. Silica is another form of ZIC. Another example of a suitable inorganic carrier includes inorganic tubules, where the perfume or other active material is contained within the lumen of the nano- or micro-tubules. Preferably, the perfume-loaded inorganic tubule (or Perfume-Loaded Tubule or PLT) is a mineral nano- or micro-tubule, such as halloysite or mixtures of halloysite with other inorganic materials, including other clays. The PLT technology may also comprise additional components on the inside and/or outside of the tubule for the purpose of improving in-product diffusion stability, deposition on the desired situs or for controlling the release rate of the loaded perfume. Monomeric and/or polymeric materials, including starch encapsulation, may be used to coat, plug, cap, or otherwise encapsulate the PLT. Suitable PLT systems as well as methods of making same may be found in U.S. Pat. No. 5,651,976.

Organic Solvents

Other optional components include organic solvents, especially water miscible solvents and co-solvents useful as solublizing agents for polymeric structurants and as drying accelerators. Non-limiting examples of suitable solvents include alcohols, esters, ketones, aromatic hydrocarbons, aliphatic hydrocarbons, ethers, and combinations thereof. Alcohols and esters are more preferred. Preferred alcohols are monohydric. The most preferred monohydric alcohols are ethanol, iso-propanol, and n-propanol. The most preferred esters are ethyl acetate and butyl acetate. Other non-limiting examples of suitable organic solvents are benzyl alcohol, amyl acetate, propyl acetate, acetone, heptane, iso-butyl acetate, iso-propyl acetate, toluene, methyl acetate, isobutanol, n-amyl alcohol, n-butyl alcohol, hexane, and methyl ethyl ketone. methanol, ethanol, n-propanol, isopropanol, n-butanol, isobutanol, methylethylketone, acetone, and combinations thereof.

Additional Adjunct Ingredients

In another embodiment, the functionalized substrate further comprises additional adjunct ingredients. These additional adjunct ingredients can act as processing aids and modify substrate properties such as solubility and rate of dissolution, dissolution stability, resistance to moisture pickup from humidity in storage, stretchability, feel, brittleness, and texture of the substrate, appearance and shine, and ease and speed of processing, casting, extruding, or drying the substrate, mechanical handling of the substrate, and storage of the substrate. The film-forming water soluble polymers (for example, PVA with or without copolymers) may be further modified with various reagents commonly employed in the film preparation art such as plasticizers, surfactants, emulsifiers, non-film forming polymers, anti-block agents, antifoamers, defoamers, biocides, perfumes, preservatives, colorants, opacifiers, pearlescing agents, fillers and bulking agents, air or nitrogen, and the like.

Antifoam agents include the silicone polymers and silica, and defoamers include tallow compounds.

Useful biocides comprise any of the many known materials having efficacy against bacteria and other degrading organisms but which are non-toxic to handlers and to mammals or persons in the environment of use. Such agents and the principles of selection are well known to those skilled in the art. Suitable biocides include quaternary ammonium salts such as alkyl (C8-C18) di (lower alkyl) benzylammonium chloride, dialkyldimethylammonium bromide, and 1,2 benzisothiazolinon-3-one (BIT).

Other useful additives include mica, ethylene glycol distearate, talc, zeolites, cyclodextrins, clays, polyethylene, dispersions of polyethylene waxes, starch and starch derivatives, and cellulose and cellulose derivatives.

Additional additives suitable for use herein include: plasticizers, lubricants, release agents, fillers, extenders, antiblocking agents, detackifying agents, antifoams, and other ingredients as disclosed in U.S. Pat. No. 6,787,512 at col. 6, line 25-col. 7, line 25.

Product Form

The article can be produced in any of a variety of product forms, including dissolvable porous solids used alone or in combination with other hand wash components. In some embodiments, the article is in the form of one or more flat sheets or pads of an adequate size to be able to be handled easily by the user. It may have a square, rectangle or disc shape or any other suitable shape. The pads can also be in the form of a continuous strip including delivered on a tape-like roll dispenser with individual portions dispensed via perforations and or a cutting mechanism. Alternatively, the articles may be in the form of one or more cylindrical objects, spherical objects, tubular objects or any other three-dimensionally shaped object.

The article may comprise one or more textured, dimpled or otherwise topographically patterned surfaces including letters, logos or figures. The textured substrate preferably results from the shape of the substrate, in that the outermost surface of the substrate contains portions that are raised with respect to other areas of the surface. The raised portions can result from the formed shape of the article, for example the article can be formed originally in a dimpled or waffle pattern. The raised portions can also be the result of creping processes, imprinted coatings, embossing patterns, laminating to other layers having raised portions, or the result of the physical form of the dissolvable porous solid substrate itself. The texturing can also be the result of laminating the substrate to a second substrate that is textured. One example of printing on the dissolvable porous substrate can be achieved using jet printing or ink-jet type printing. Such industrial printing techniques are known. See e.g., WO 03/091028 A1; WO 00/20157; U.S. Pat. No. 5,463,416. In one embodiment, the printing does not contact the film or substrate. This technique may prove useful when wishing not to disturb the film based on manufacturing efficiencies or simply because of the presence of embossings or other ornamental features on the film or substrate. Messages, ornamental designs, pictures, and the like may also be printed using methods such as those described in WO 2005/002360. In another embodiment, graphics may be printed in 2D or 3D with UV curable dye that is water-soluble or at least partially water-soluble.

In yet another embodiment, the functional composition is a powder or substantially a solid. In this embodiment, the powder or solid composition is printed onto the film or substrate.

In some embodiments, the article can be perforated with holes or channels penetrating into or through the porous solid. These perforations can be formed during the drying process via spikes extended from the surface of the underlying mold, belt or other non-stick surface. Alternatively, these perforations can be formed after the drying process via poking or sticking the porous solids with pins, needles or other sharp objects. In some embodiments, these perforations are great in number per surface area, but not so great in number so as to sacrifice the integrity or physical appearance of the porous solid. It has been found that such perforations may increase the dissolution rate of the porous solids into water relative to un-perforated porous solids.

In yet other embodiments, the porous solid may contain two or more discreet regions wherein the porous solid has stiffer and softer regions to allow the porous solid to be use to scrub away soils from a hard surface prior to dissolving. The porous solid may consist of two or more porous solids adheared together of different porosity and cleaning features.

In some embodiments, the article can be delivered via a water insoluble implement or device. In some embodiments, the article may be adsorbed to the surfaces a separate high surface area water-insoluble implement, i.e., a porous sponge, a puff, a flat sheet etc. For the latter, the dissolvable porous solid of the present invention may be adsorbed as a thin film or layer.

I. Method of Manufacture

Articles according to the present invention may be manufactured by a process comprising: (1) preparing a solution comprising surfactant, film-forming water-soluble polymer, hydrotrope, water, suds booster and in some embodiments optional components such as plasticizer for example; (2) aerating the solution by introducing gas into the solution to form a wet aerated product; (3) forming the aerated wet aerated product into one or more shapes to form a shaped wet product; and (4) drying the shaped wet product to a desired Remaining Water content to form a porous dissolvable solid structure. One or more of the following optional steps may also be performed: (O-1) cutting the porous dissolvable solid structure into a shape; (O-2) adding optional component(s) to the porous dissolvable structure. (O-3) Molding into various shapes.

(1) Preparing a First Solution

In some embodiments, a solution may be prepared by dissolving water soluble polymer in the presence of surfactant, hydrotrope, water, suds booster and optionally plasticizer and/or other optional components, by heating followed by cooling. The solution may be prepared using any suitable heated batch agitation system or any suitable continuous system involving either single screw or twin screw extrusion or heat exchangers together with either high shear or static mixing. Any process can be envisioned such that the polymer is ultimately dissolved in the presence of the other components in the solution. In some embodiments, step-wise processing via pre-mix portions of any combination of components may be useful.

In some embodiments, the first solution of the present invention comprises from about 20% to about 45% solids, in some embodiments from about 25% to about 40% solids, and in other embodiments from about 28% to about 39% solids, by weight of the processing mixture before drying; and has a viscosity of from about 2,500 cps to about 200,000 cps, in some embodiments from about 5,000 cps to about 180,000 cps, in some embodiments from about 7,500 cps to about 150,000 cps, and in some embodiments from about 10,000 cps to about 100,000 cps.

The % solids content is the summation of the weight percentages by weight of the total solution at issue of all of the solid, semi-solid and liquid components excluding water and any obviously volatile materials such as low boiling alcohols. The solution viscosity values are measured using a TA Instruments AR500Rheometer with 4.0 cm diameter parallel plate and 1,200 micron gap at a shear rate of 1.0 reciprocal seconds for a period of 30 seconds at 23° C.

(2) Aerating the Solution

The aeration of the solution to form a wet aerated product may be accomplished by introducing a gas into the solution, such as by mechanical mixing energy and or via chemical means. The aeration may be accomplished by any suitable mechanical processing means, including but not limited to: (i) Batch tank aeration via mechanical mixing including planetary mixers or other suitable mixing vessels, (ii) semi-continuous or continuous aerators utilized in the food industry (pressurized and non-pressurized), or (iii) spray-drying the processing mixture in order to form aerated beads or particles that can be compressed such as in a mould with heat in order to form the porous solid.

In some embodiments, the wet aerated product can be prepared within continuous pressurized aerators that are conventionally utilized within the foods industry in the production of marshmallows. Suitable continuous pressurized aerators include the Morton whisk (Morton Machine Co., Motherwell, Scotland), the Oakes continuous automatic mixer (E. T. Oakes Corporation, Hauppauge, N.Y.), the Fedco Continuous Mixer (The Peerless Group, Sidney, Ohio), and the Preswhip (Hosokawa Micron Group, Osaka, Japan).

(3) Forming the Wet Aerated Product

The second solution may be formed into the wet aerated product using any suitable means to form the mixture in a desired shape or shapes including, but not limited to (i) depositing the aerated second solution to moulds of the desired shape and size comprising a non-interacting and non-stick surface including, but not limited to aluminium, Teflon, metal, HDPE, polycarbonate, neoprene, rubber, LDPE, glass and the like; (ii) depositing the aerated second solution into cavities imprinted in dry granular starch contained in a shallow tray, otherwise known as starch moulding forming technique; and (iii) depositing the aerated second solution onto a continuous belt or screen comprising any non-interacting or non-stick material Teflon, metal, HDPE, polycarbonate, neoprene, rubber, LDPE, glass and the like which may be later stamped, cut, embossed or stored on a roll.

(4) Drying the Shaped Wet Product

The drying of the shaped wet product to form the porous dissolvable structure may be accomplished by any suitable means including, but not limited to utilization of (i) drying room(s) including rooms with controlled temperature and pressure or atmospheric conditions; (ii) ovens including non-convection or convection ovens with controlled temperature and optionally humidity; (iii) Truck/Tray driers, (iv) multi-stage inline driers; (v) impingement ovens; (vi) rotary ovens/driers; (vii) inline roasters; (viii) rapid high heat transfer ovens and driers; (ix) dual plenum roasters, (x) conveyor driers and any combination thereof.

Optional components may be imparted during any of the above described four processing steps or even after the drying process.

The article may also be prepared with chemical foaming agents by in-situ gas formation (via chemical reaction of one or more components, including formation of $CO_2$ by an effervescent system).

(O-1) Cutting the Porous Dissolvable Solid Structure

In some embodiments, the process of the present invention comprises the step of cutting the porous dissolvable solid structure into one or more shapes. This may be accomplished using any suitable means.

(O-2) Adding Optional Components

In some embodiments, the process of the present invention comprises the step of adding optional components to the porous dissolvable structure. This may be accomplished using any suitable means. Non-limiting examples of such means include spray-drying, powdering, dipping, coating and any combination thereof.

(O-3) Means of molding (injection and casting into a mold) In some embodiments, the process of the present invention comprises the step of forming the wet composition into a molded shape by means of injection molding, extrusion, or casting onto a continuous belt or screen which may be later stamped, cut, embossed or stored on a roll, or casting onto a continuous belt that has been imprinted with cavities to result in a moulded shape.

II. Physical Characteristics

Dissolution Rate

The article has a Dissolution Rate that allows the porous solid to rapidly disintegrate during use application with water. The Dissolution Rate of the article is determined in accordance with the methodology described below.

Conductivity Dissolution Method: In a 500 ml beaker, 300 grams of distilled water is weighed at room temperature. The beaker is placed on an orbital shaker, for example a VWR model DS-500E and started at 150 RPM. A conductivity probe, for example a VWR model 2052 connected to a VWR conductivity meter, is submerged just below the surface of the water in such a manner that the conductivity probe remains stationary in relation to the motion of the beaker and never touches the side of the beaker. A 0.20+/−0.01 grams of the dissolvable porous solid is weighed and placed into the water. Conductivity data is recorded every 15 seconds for 6 minutes, and then once a minute until 30 minutes. The final value is recorded when the conductivity values stopped changing or 30 minutes is reached, which ever is earlier. The conductivity dissolution time is taken as the time it takes in seconds until the conductivity values stop changing or as the maximum of 30 minutes, which ever happens first.

The article has a conductivity dissolution time of from about 100 seconds to about 2,000 seconds, in another embodiment from about 200 seconds to about 1000 seconds, in yet another embodiment from about 250 seconds to about 600 seconds, and in still another embodiment from about 200 seconds to about 400 seconds.

Methods of Use

The articles of the present invention have a multitude of applications and methods of use. One application for functional substrates described herein is in the field of hand dish washing. One is a method of dispensing a hand dish composition by contacting the porous substrate with an aqueous solution; at least partially dissolving the substrate; thereby releasing the hand dish composition including any actives therein. Another is a method of dispensing an encapsulated perfume comprising: contacting an article according to the present invention with an aqueous solution; at least partially dissolving the article; thereby releasing at least one encapsulated functional material (e.g. perfume) from the article. Another suitable method of use further comprises, the step of contacting the article with an aqueous solution comprising at least partially immersing said article in an aqueous solution. Yet another method of use is administering the article into a tub, sink, basin, bucket or container in the hand washing step, rinsing step or both.

In some embodiments, where a hand dish solution is prepared by dispensing one or more articles into an aqueous solution (for pre-soak, wash and/or rinse solutions). The resulting aqueous solution may comprise from about 0.1 ppm and about 500 ppm of the article. Further, conventional hand dish compositions with or without perfume can also be used.

In some embodiments, the article may be wetted and used to apply hand dish detergent directly to the article to be washed.

Article of Commerce

The present invention provides for an article of commerce comprising one or more articles described herein, and a communication directing a consumer to dissolve the porous dissolvable solid structure in water via a dispenser or via direct addition to the water by the consumer. The communication may be printed material attached directly or indirectly to packaging that contains the article or may be printed on the article itself. Alternatively, the communication may be an electronic or a broadcast message that is associated with the article of manufacture. Alternatively, the communication may describe at least one possible use, capability, distinguishing feature and/or property of the article of manufacture.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. All exemplified amounts are concentrations by weight of the total composition, i.e., wt/wt percentages, unless otherwise specified.

Example 1

Polyvinyl Alcohol and Glycerin Solution

The following polymer solution compositions were prepared for use during the preparation of the dissolvable porous solids of the present invention:

| Component | Ex. 1A Wt % | Ex. 1B Wt % | Ex. 1C Wt % |
|---|---|---|---|
| Polyvinyl alcohol[a] | 22.00 | 14.00 | 22.53 |
| Glycerin | 7.33 | 15.50 | 0.0 |
| Distilled water | 70.67 | 70.50 | 77.47 |
| Total | 100.00 | 100.00 | 100.00 |

[a]87-89% hydrolyzed, MW 85,000 to 124,000 available from Sigma Aldrich (Catalog Number 363081)

Into an appropriately sized and cleaned vessel, the distilled water and glycerin is added with stifling at 100-300 rpm. The polyvinyl alcohol is weighed into a suitable container and slowly added to the main mixture in small increments using a spatula while continuing to stir while avoiding the formation of visible lumps. The mixing speed is adjusted to minimize foam formation. The mixture is slowly heated to 82° C. while continuing to stir, and is heated at 82° C. for at least 30 min. The mixing vessel is covered to minimize evaporation.

Example 2

Processing of the Open Cell Foam Formulations

1. Surfactant mixture and the PVOH solution are combined, at ≧70° C. into a KitchenAid Pro 500 mixer.
2. Composition is mixed together with a flat beater at 220-240 RPMs for 3:00 min
3. Stop the mixer and aerate the mixture for 3:00 min
4. Remove mixture and place into appropriate molds
5. Dry mixture in 135° C. oven for 50:00) minute
6. Cool mixture at room temperature (≧30 minutes).
7. The dry sponge is now ready for adding additional functional actives
8. The finished open celled foam is removed for hand dish applications.

Example 3

| Hand Dish Opened Cell Foam Composition | Wet Composition | Dried Open Celled Foam Composition |
|---|---|---|
| Sodium C12/14 alcoholethoxylate(0.6)sulfate | 20.726 | 46.688 |
| 1,3-Bismethylaminocyclohexane | 0.232 | 0.522 |
| C12/14 Amine Oxide | 4.797 | 10.805 |
| Sodium Cumene Sulfonate | 0.889 | 2.002 |
| Ethanol | 0.867 | 1.953 |
| Sodium chloride | 0.560 | 1.261 |
| Magnesium chloride | 0.242 | 0.546 |
| pH Trim - hydrochloric acid | 0.400 | 0.901 |
| Sodium hydroxide | 0.216 | 0.487 |
| Acticide M2OS (MIT) | 0.020 | 0.045 |
| Starch 1500* | 5.000 | 11.263 |

-continued

| Hand Dish Opened Cell Foam Composition | Wet Composition | Dried Open Celled Foam Composition |
|---|---|---|
| Polyvinylalcohol, MW = 83-90k | 10.000 | 22.526 |
| Water (balance) | 56.351 | 1.000 |
| Total | 100% | 100% |

*Partially Pregelatinized Maize Starch; Colorcon/Product # 2001/Lot # IN512486

The open celled foam can be used in a direct application, in a basin or sink with water to clean dinner and table ware including but not limited to dishes, glasses, pots, pans, bakeware, silverware, cooking utensils, and the like.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited herein are incorporated herein by reference in their entirety; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hand dish cleaning composition article comprising by dry weight percentage:

a. from about 5% to about 70% surfactant;
b. from about 0.005% to about 2% divalent ion;
c. from about 5% to about 60% film-forming water-soluble polymer;
d. from 0% to about 20% plasticizer;
e. from about 0.05% to about 10% hydrotrope;
f. from 0% to about 0.5% enzyme;
g. from about 1% to about 10% suds booster; and
h. from about 0.05 to about 5% remaining water;

such that the article is in the form of a first flexible porous dissolvable solid structure having a dry density and a having percent open cell content of from about 5% to about 99.9%.

2. A process of making a hand dish cleaning composition article comprising the steps. of:

a. preparing a solution comprising surfactant, film-forming water-soluble polymer, hydrotrope, water, suds booster and optionally plasticizer, wherein said first solution comprises from about 20% to about 45% solids by weight of said solution;
b. aerating said solution by introducing gas into said solution to form a wet aerated product;
c. forming said wet aerated product into a desired shape to form a shaped wet product; and
d. drying said shaped wet product to a desired remaining water content to form a porous dissolvable solid structure.

* * * * *